US007070469B2

(12) United States Patent
Stallings

(10) Patent No.: US 7,070,469 B2
(45) Date of Patent: Jul. 4, 2006

(54) DUAL PROPELLER SURFACE DRIVE PROPULSION SYSTEM FOR BOATS

(76) Inventor: James Stallings, 5432 FM 415, Timpson, TX (US) 75975

( * ) Notice: Subject to any disclaimer, the term of this patent is extended or adjusted under 35 U.S.C. 154(b) by 0 days.

(21) Appl. No.: 11/225,782

(22) Filed: Sep. 12, 2005

(65) Prior Publication Data

US 2006/0057910 A1 Mar. 16, 2006

Related U.S. Application Data

(60) Provisional application No. 60/609,874, filed on Sep. 15, 2004.

(51) Int. Cl.
*B63H 5/07* (2006.01)

(52) U.S. Cl. ..... 440/79; 440/57

(58) Field of Classification Search ..... 440/79–81, 440/57, 51, 112

See application file for complete search history.

(56) References Cited

U.S. PATENT DOCUMENTS

| | | | | |
|---|---|---|---|---|
| 2,936,730 | A | 5/1960 | Patty, Jr. | |
| 3,128,742 | A | 4/1964 | Cameron | |
| 3,289,628 | A | 12/1966 | Sable | |
| 3,376,842 | A * | 4/1968 | Wynne | 440/56 |
| 3,745,963 | A | 7/1973 | Fisher | |
| 3,922,997 | A | 12/1975 | Jameson | |
| 3,954,083 | A * | 5/1976 | Frostrom | 440/61 R |
| 3,995,579 | A | 12/1976 | Childre | |
| 4,344,760 | A | 8/1982 | Kulikowski | |
| 4,383,829 | A | 5/1983 | Allen, Jr. et al. | |
| 4,487,587 | A * | 12/1984 | Friedel et al. | 440/51 |
| 4,815,996 | A | 3/1989 | Carr | |
| 5,215,486 | A | 6/1993 | Rizikow | |
| 5,279,509 | A * | 1/1994 | Gifford | 440/51 |
| 5,326,294 | A * | 7/1994 | Schoell | 440/79 |
| 5,413,512 | A | 5/1995 | Belenger | |
| 5,494,466 | A | 2/1996 | Vernea | |
| 5,879,207 | A | 3/1999 | Edmon | |
| 5,890,938 | A | 4/1999 | Eick et al. | |
| 6,066,012 | A | 5/2000 | Nagle | |
| 6,234,853 | B1 | 5/2001 | Lanyi et al. | |
| 6,361,387 | B1 | 3/2002 | Clarkson | |
| 2001/0051475 | A1 | 12/2001 | Reuter et al. | |

FOREIGN PATENT DOCUMENTS

| | | | |
|---|---|---|---|
| EP | 0438087 | A1 * | 1/1991 |
| GB | 2 301 804 | A | 12/1966 |
| WO | WO 86/01483 | | 3/1986 |

* cited by examiner

*Primary Examiner*—Ed Swinehart
(74) *Attorney, Agent, or Firm*—Richard C. Litman

(57) ABSTRACT

The dual propeller surface drive propulsion system for boats is a combined propulsion and steering system for vessels with inboard engines comprising an enclosed thrust bearing assembly mounted to the transom of the vessel, a transom box mounted to the transom of the vessel that encompasses the thrust bearing assembly, an articulated outdrive pivotally connected to the transom box, a gearbox contained within the articulated outdrive, two counter rotating propeller shafts equipped with surface-piercing propellers and a steerable rudder system. Counter-rotating propellers reduce propeller-induced torque. By combining an articulated outdrive with a steerable rudder greater maneuverability of the vessel is achieved.

10 Claims, 6 Drawing Sheets

DUAL PROPELLER SURFACE DRIVE PROPULSION SYSTEM FOR BOATS

This application claims priority from U.S. Provisional Patent Application Ser. No. 60/609,874 filed Sep. 15, 2004, titled Dual Propeller Surface Drive Propulsion System for Boats.

SPECIFICATIONS

TITLE OF THE INVENTION

Dual propeller surface drive propulsion system for boats
Inventor:

| NAME | CITIZENSHIP | RESIDENCE |
|---|---|---|
| James Stallings | U.S. | 5432 FM 415<br>Timpson, TX 75975 |

BACKGROUND OF INVENTION

The present invention relates to marine propulsion systems, and more particularly, to a propulsion system for a boat that splits the power from the engine to drive two surface-piercing propellers in a counter-rotating manner in order to eliminate drive torque or rotation about the longitudinal axis of the boat.

DESCRIPTION OF THE RELATED ART

A surface-piercing propeller is a propeller that is located so that when a boat is underway, the hub of the propeller is approximately at the waterline. Surface-piercing props are currently used on vessels from small pleasure craft to high-speed ferries. Unlike the traditional submerged propeller, which can be placed underneath the hull of a vessel, a surface-piercing propeller must be positioned aft of the transom.

A vessel that utilizes surface piercing propellers can use a variety of drive and steering mechanisms. The types of mechanisms currently known in the art break in to two categories. The first is a stern drive inboard/outboard unit with an outdrive that is articulated for steering. The second is a fixed propeller shaft with a rudder for steering.

Articulated surface drive systems and fixed propeller shaft systems both have advantages and disadvantages. Advantages of an articulated system include increased maneuverability, shallow draft capability, and the ability to adjust the submergence of the propeller. A fixed propeller shaft system does not have the complicated universal joint driveline or hydraulic system related to an articulated system and is less prone to breakage. Some of the disadvantages to the articulated surface drive system are poor reversing capabilities and decreased efficiency at slower speeds. Fixed drive systems have problems with appendage drag and cavitation when the propeller is submerged. Both systems have trouble with propeller induced torque and maneuverability.

What is needed is an invention to solve some of the problems associated with the current state of the art for surface drive systems. A variety of ideas have been put forward in the field of surface drive propulsion and steering including: U.S. Pat. No. 4,645,463, issued 24 Feb. 1987 to Howard M. Arneson, describes a marine outdrive apparatus.

The '463 patent discloses one of the first versions of an articulated surface drive system. U.S. Pat. No. 4,976,638, issued 11 Dec. 1990 to James E. Grinde, shows a surface drive for marine craft having an inboard engine. The '638 patent teaches the use of a constant velocity U-joint to connect the propeller shaft to the drive shaft in order to reduce the size of the surface drive unit.

Other ideas put forth in the field of marine propulsion and steering include the following: U.S. Pat. No. 2,936,730, issued 17 May 1960 to Harry R. Patty, Jr., shows a tiltable and steerable dual propeller drive for boats equipped with inboard motors. Unlike the present invention, the tiltable and steerable dual propeller drive is designed to perform as an outboard motor and not to utilize surface piercing propellers. U.S. Pat. No. 3,289,628, issued 6 Dec. 1966 to Carl Sable, teaches a marine propulsion apparatus. The marine propulsion apparatus primarily is designed to reduce engine noise and vibration. U.S. Pat. No. 6,361,387 B1, issued 26 Mar. 2002 to Daniel E. Clarkson, describes a marine propulsion apparatus with dual drive shafts extending from the forward end of an engine. The marine propulsion apparatus does not include a steering means.

Further patent documents applicable to the present invention include the following: U.S. Patent Application Publication No. 2001/0051475 A1, published 13 Dec. 2001 to Reinhold Reuter et al. (twin-propeller drive for watercraft); U.S. Pat. No. 3,128,742, issued 14 Apr. 1964 to C. E. Cameron (power transmission): U.S. Pat. No. 3,745,963, issued 17 Jul. 1973 to Wesley H. Fisher (boat structure); U.S. Pat. No. 3,922,997, issued 2 Dec. 1975 to James J. Jameson (marine power transmission): U.S. Pat. No. 3,954,083, issued 4 May 1976 to James K. Frostrom (twin-propeller stem drive); U.S. Pat. No. 3,995,579, issued 7 Dec. 1976 to Lewis Childre (dual motor propulsion and steering control system); U.S. Pat. No. 4,344,760 issued 17 Aug. 1982 to Andrzej S. Kulikowski (marine propulsion system); U.S. Pat. No. 4,383,829, issued 17 May 1983 to Harry L. Allen, Jr. et al (drive assembly for inboard speedboat; U.S. Pat. No. 4,815,996, issued 28 Mar. 1989 to Harold B. Carr (marine propulsion and control arrangement); U.S. Pat. No. 5,215,486, issued 1 Jun. 1993 to Mauricio Rizikow (dual propeller outboard assembly); U.S. Pat. No. 5,413,512, issued 9 May 1995 to Robert V. Belenger (multi-propeller drive system); U.S. Pat. No. 5,494,466, issued 27 Feb. 1996 to Stefan Vernea (transmission for dual propellers driven by an inboard marine engine); U.S. Pat. No. 5,879,207, issued 9 Mar. 1999 to Arthur C. Edmon (single engine dual propeller water craft); U.S. Pat. No. 5,890,938, issued 6 Apr. 1999 to Edward C. Eick et al (marine counter-rotational propulsion system); U.S. Pat. No. 6,066,012, issued 23 May 2000 to Thomas J. Nagle (propulsion system for a marine vessel); U.S. Pat. No. 6,234,853, issued 22 May 2001 to William D. Lanyi et al (simplified docking method and apparatus for a multiple engine marine vessel) United Kingdom Patent Application No. 2301804 A, published 18 Aug. 1996 (dual propeller marine drive); W.I.P.O. Patent Application No. WO 86/01483, published 13 Mar. 1986 (contra-rotating propeller drive).

none of the above inventions and patents, taken either singly or in combination, is seen to describe the instant invention as claimed. Thus a dual prop surface drive propulsion system for boats solving the aforementioned problems is desired.

BRIEF SUMMARY OF THE INVENTION

The dual propeller surface drive propulsion system for boats is a combined propulsion and steering system for vessels with inboard engines comprising an enclosed thrust bearing assembly mounted to the transom of the vessel, a transom box mounted to the transom of the vessel that encompasses the thrust bearing assembly, an articulated outdrive pivotally connected to the transom box, a gearbox contained within the articulated outdrive, two counter rotating non-coaxial propeller shafts equipped with surface-piercing propellers, and a steerable rudder system. Counter-rotating propellers reduce propeller-induced torque. By combining an articulated outdrive with a steerable rudder, greater maneuverability of the vessel is achieved.

Accordingly, it is a principal object of the invention to reduce propeller-induced torque.

It is another object of the invention to increase the maneuverability of vessels equipped with surface drive systems.

It is a further object of the invention to make the gearbox system more accessible to boat users.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

DETAILED DESCRIPTION OF THE INVENTION

Figure 1:
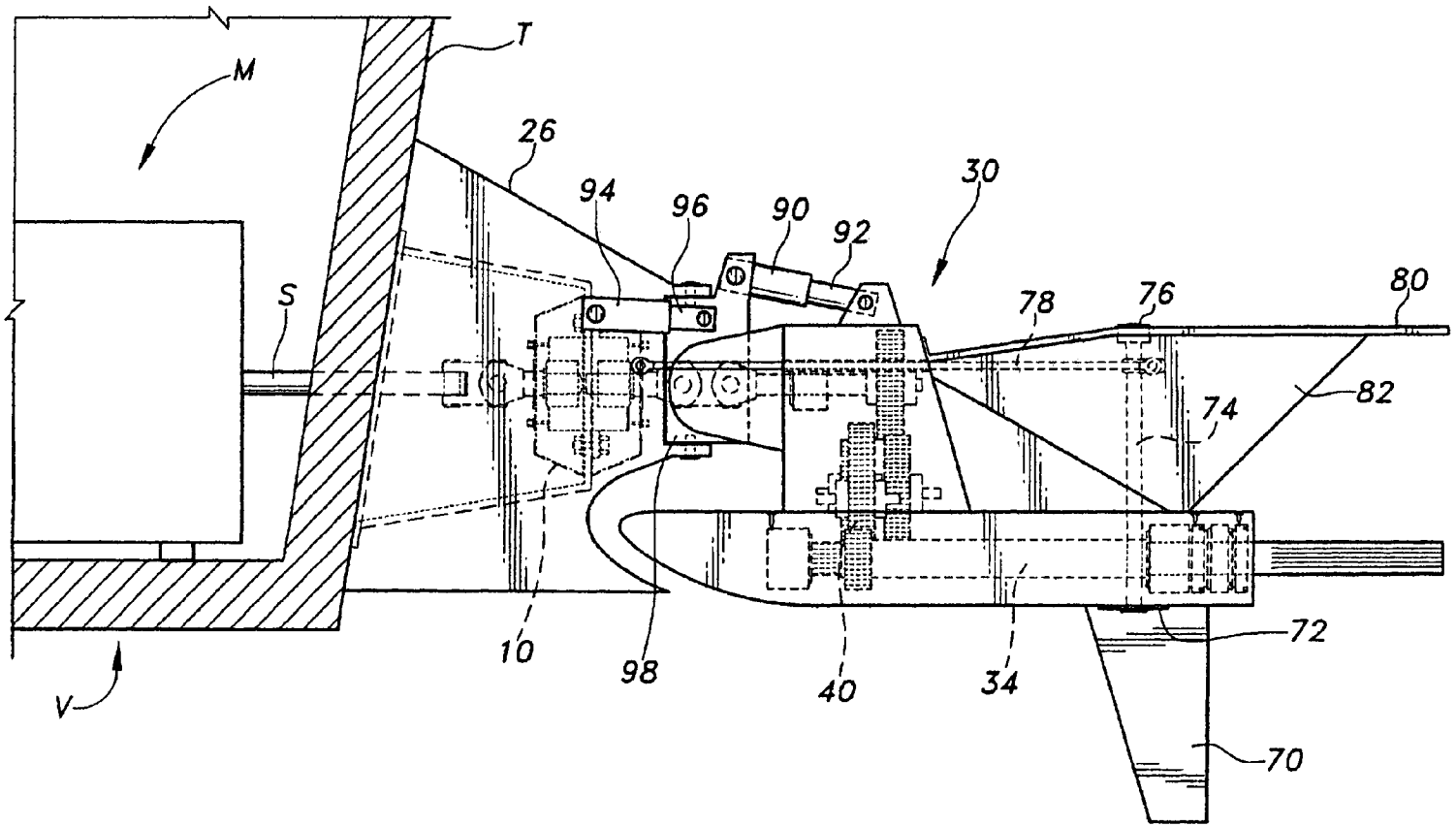
FIG. 1 is a side view of a dual propeller surface drive propulsion system for boats attached to a vessel according to the present invention.

The present invention is a dual propeller surface drive for boats. Referring to FIG. 1, the dual propeller surface drive is designed for use with a marine vessel V with an inboard motor M. Inboard motor M has a rotating output shaft S that pierces the transom T of the vessel V. Output shaft S is connected to a thrust bearing assembly, referred to generally as 10. The thrust bearing assembly 10 is mounted on to the transom T and comprises a thrust bearing 12 having an input yoke 14 and an output yoke 16, a first double universal joint 18 for pivotally attaching the input yoke 14 to the drive shaft S, and a second double universal joint 20 for pivotally attaching the output yoke 16 to the articulated outdrive input shaft 32. The thrust bearing assembly 10 is enclosed in a housing 22 that is mounted on to the transom T. Thrust bearing assembly 10 and housing 22 are enclosed by transom box 26. Transom box 26 is mounted on to the transom T and has a gimbal box 98 pivotally attached to the after end of the transom box 26.

The output yoke 16 is connected to an articulated outdrive, generally referees to as 30 in the drawings. The articulated outdrive 30 comprises an outdrive input shaft 32 connected to a gear box systems 40 that is capable of turning two propeller shafts 34, and 36 in a counter rotational manner. The outdrive input shaft 32, gearbox system 40, and two longitudinally positioned propeller shafts 34, 36 are supported by bearings and enclosed in a housing. Twin surface piercing propellers 62, 64 are attached to the aft end of the propeller shafts 34, 36.

Figure 4:
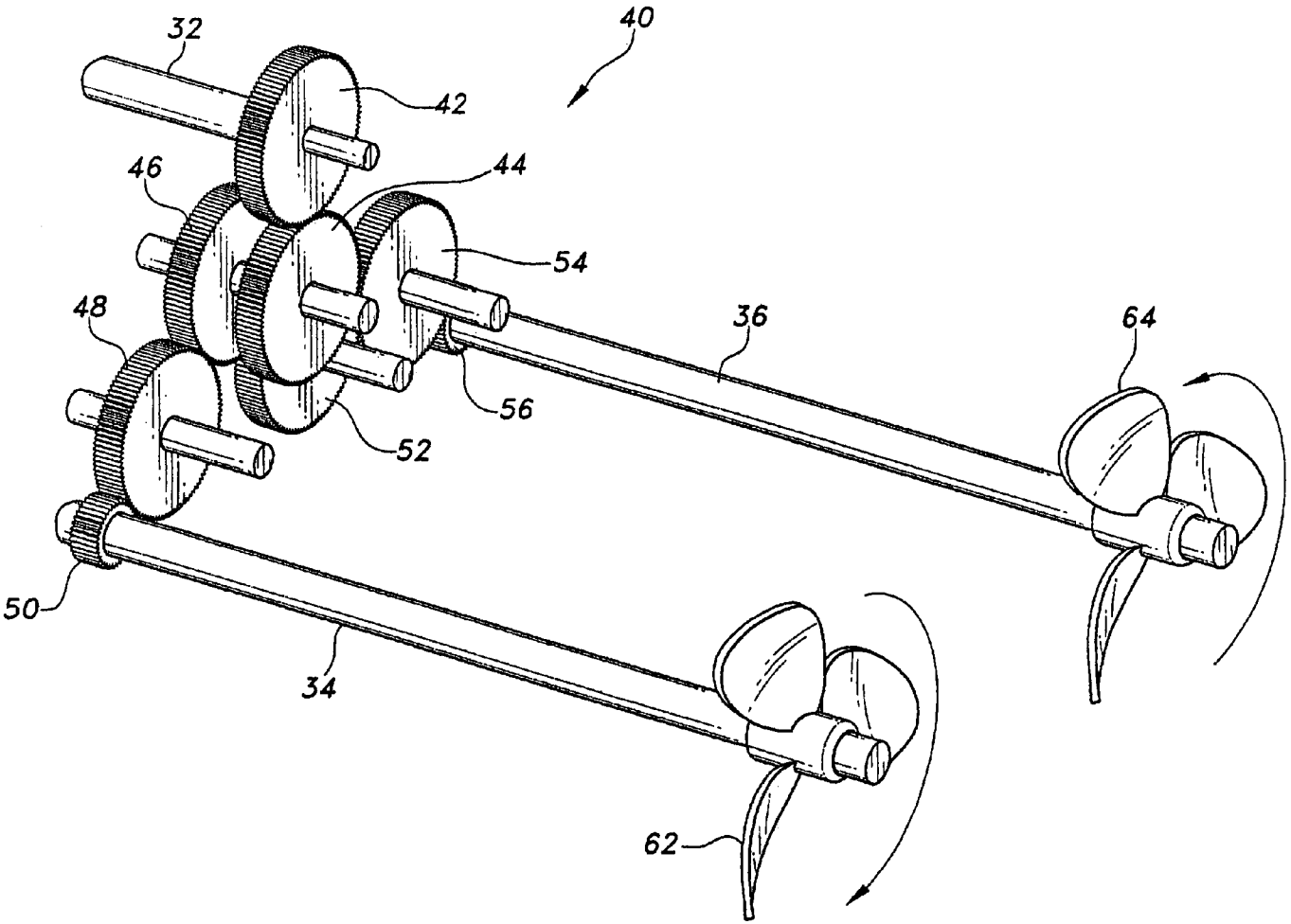
FIG. 4 is a perspective view of the gearbox assembly

One feature of the dual propeller surface drive is having the gearbox system 40 contained in the articulated outdrive 30. By placing the gearbox system 40 in the articulated outdrive 30, rather than the often cramped engine compartment of the vessel, the gearbox system 40 is much more accessible and easier to work on. An example of a gearbox system 40 contemplated for use in the present invention can be seen in FIG. 4. Gearbox system 40 comprises an upper changeable ratio gear 42, a lower changeable ratio gear 44, a main drive gear 46, a port idler gear 48, a port propeller shaft gear 50, a starboard idler gear 52, a starboard secondary idler gear to reverse rotation 54, and a starboard propeller shaft gear 56. Gearbox system 40 allows for non-coaxially propellers 62, 64 to turn in a counter-rotational manner, which reduces propeller-induced torque.

Figure 6:
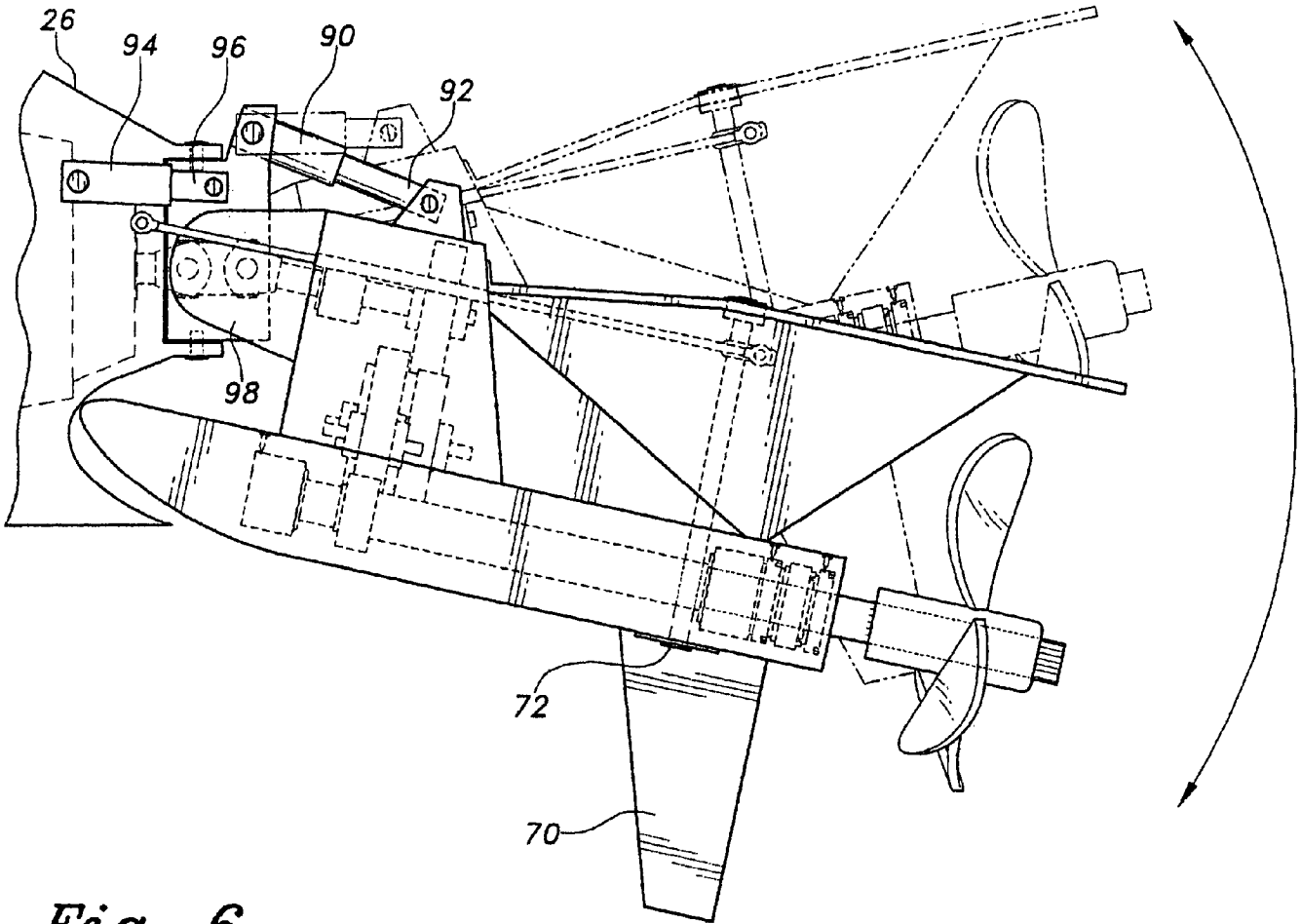
FIG. 6 is a side view of the articulate outdrive in the trim up and trim down positions. Similar reference characters denote corresponding features consistently throughout the attached drawings.

The position of articulated outdrive 30 is controlled by a pair of hydraulic cylinders. A hydraulic trim cylinder 90 is pivotally connected to the gimbal box 98 with a hydraulic trim ram 92 pivotally connected to the articulated outdrive 30. Through the use of hydraulic pressure to the trim cylinder 90 the articulated outdrive 30 can be trimmed up or trimmed down when the vessel is planing as shown in FIG. 6.

Figure 2:
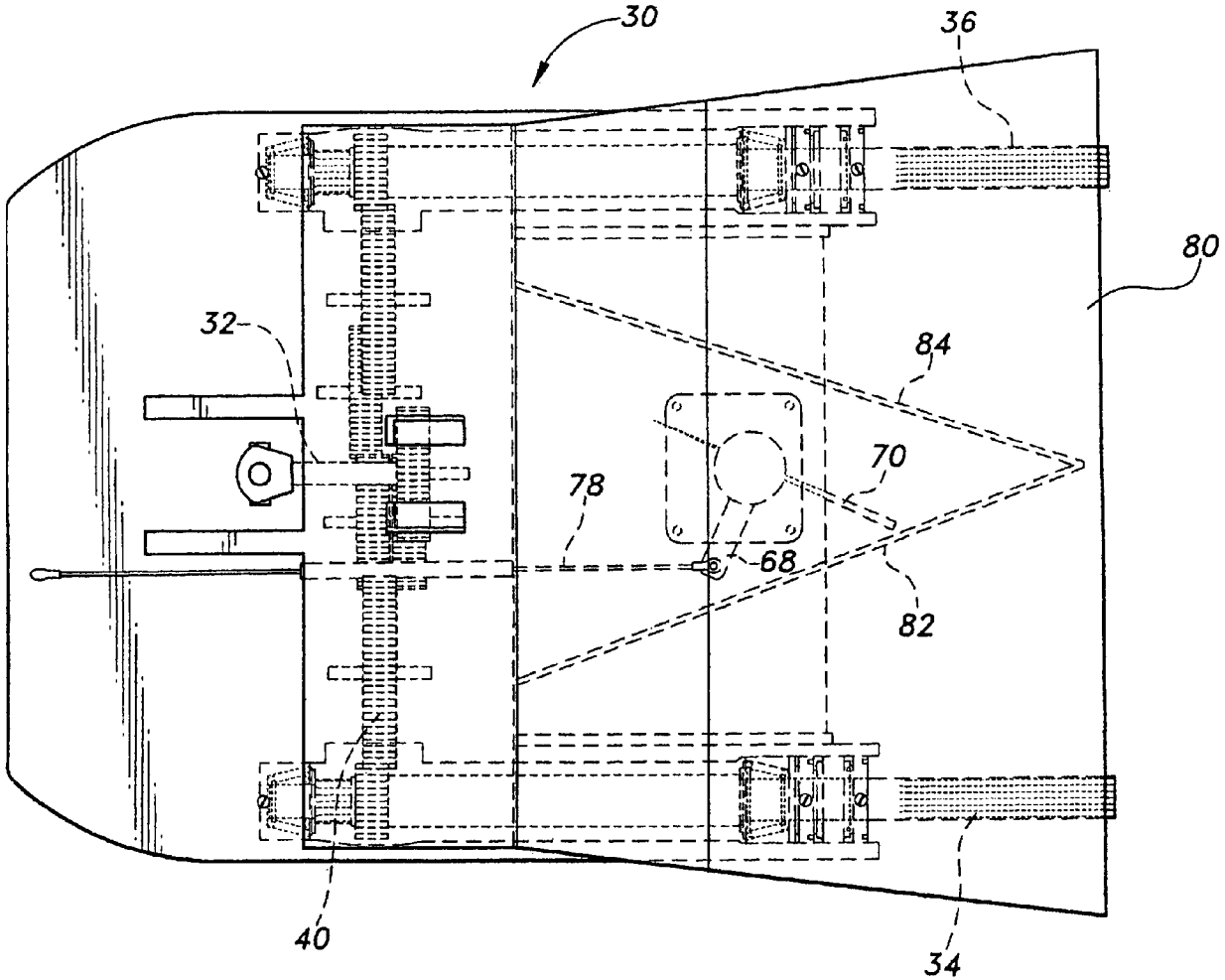
FIG. 2 is a top view of the articulated outdrive according to the present invention.
Figure 3:
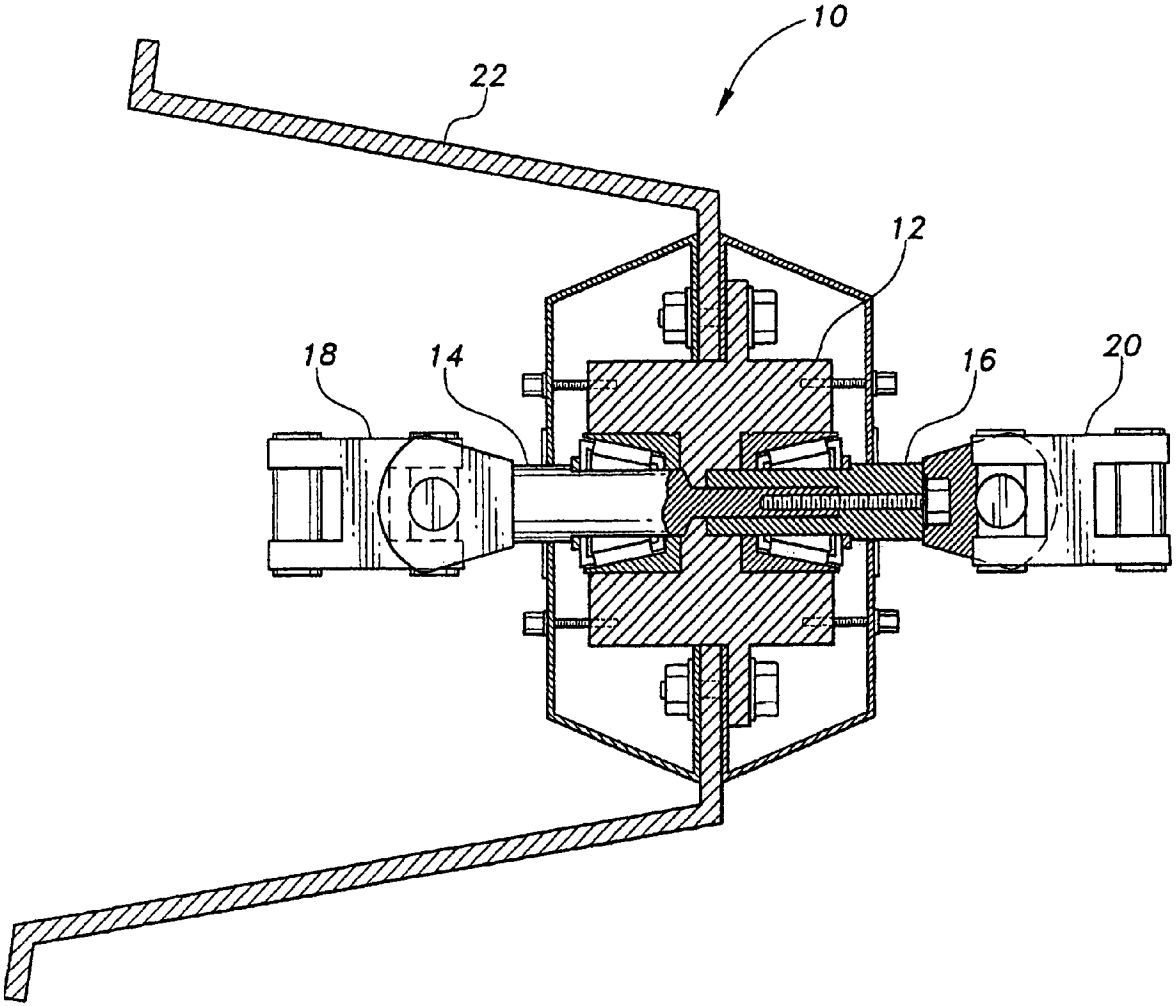
FIG. 3 is a side view of the thrust bearing assembly
Figure 5:
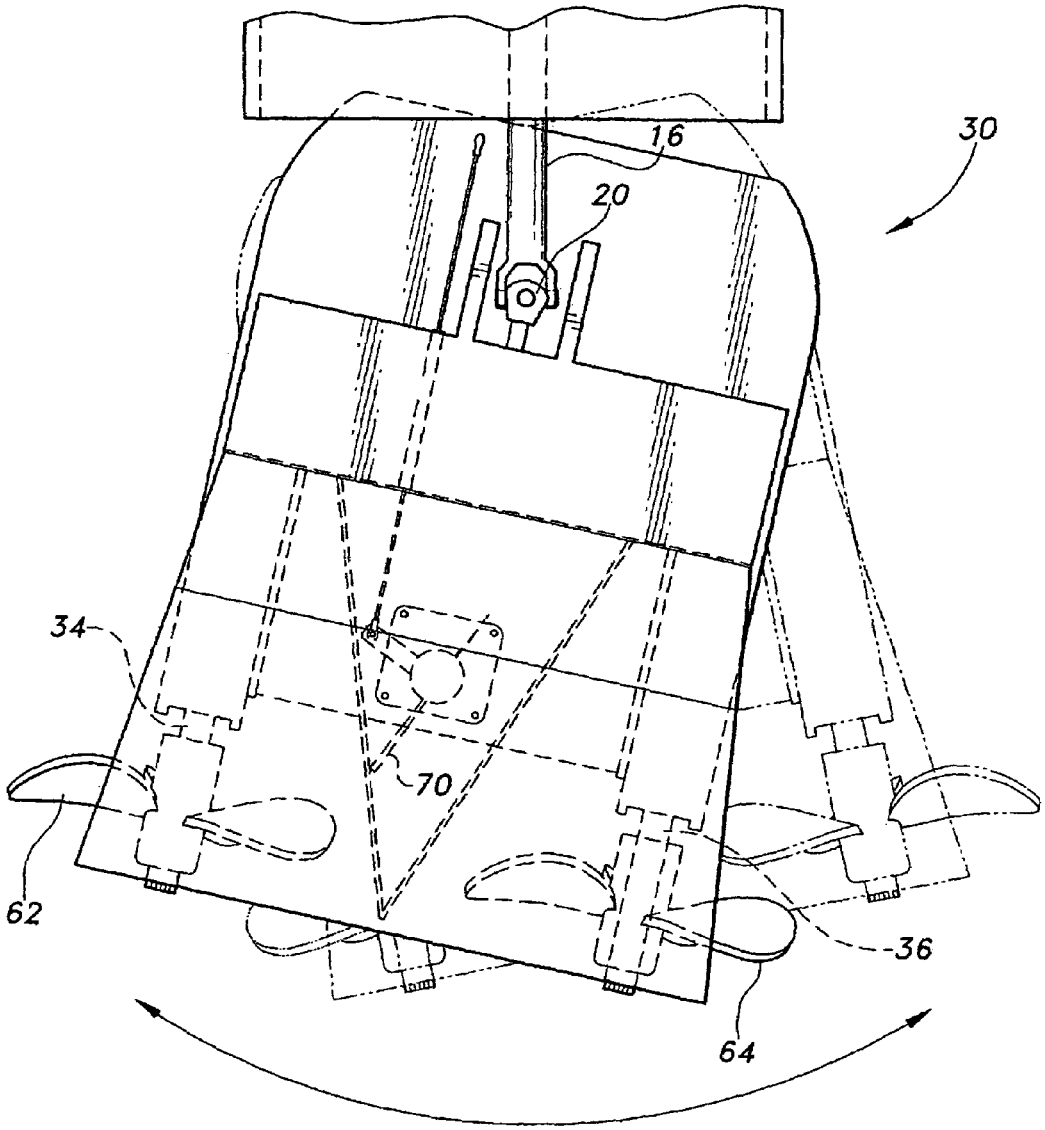
FIG. 5 is a top view of the articulated outdrive being used to steer a marine vessel.

A hydraulic steering cylinder 94 is pivotally connected to the transom box with the hydraulic steering ram 96 pivotally connected to the gimbal box 98. Through the use of hydraulic pressure to the steering cylinder 94 the articulated outdrive 30 can be directed to port or to starboard to steer the vessel as shown in FIG. 5. In addition to the steering cylinder, the articulated outdrive 30 is further equipped with a steerable rudder system. The steerable rudder system comprises a rudder 70 connected to a vertical rudder shaft 74, a rudder shaft lower bearing 72, a rudder shaft upper bearing 76, a horizontal rudder arm 68 connected to the vertical rudder shaft 74, and a rudder control linkage 78 connected to the horizontal rudder arm 68. Rudder control linkage 78 is connected to a conventional steering system within the vessel. By combining a rudder 70 with a hydraulic steering cylinder 94 to control the direction of the articulated outdrive 30, a vessel operator has a smaller turning radius and higher maneuverability of the vessel. In the preferred embodiment shown in FIGS. 1 and 2, the rudder 70 is placed amidships and forward of the propellers 62, 64 in order to allow a clean flow of water to the propellers 62, 64 and thereby reduce cavitation.

Other features of the dual propeller surface drive include a shroud 80 attached to the articulated outdrive extending over the surface-piercing propellers to reduce spray coming aboard the vessel V. The shroud 80 can be supported by two generally triangular gusset plates 82, 84 attached to the articulated outdrive 30.

It is to be understood that the present invention is not limited to the embodiments described above, but encompasses any and all embodiments within the scope of the following claims.

The invention claimed is:

1. A dual propeller surface drive propulsion system for marine vessels having inboard motors, comprising:

a drive shaft projecting from the transom of the vessel;

an enclosed thrust bearing assembly mounted to the transom of the vessel, said thrust bearing assembly being pivotally connected to the drive shaft;

a transom box mounted to the transom of the vessel that encompasses the thrust bearing assembly;

an articulated outdrive pivotally connected to the transom box by a gimbal box which allows for articulation of said articulated outdrive about a plurality of axes, and wherein the articulated outdrive has an outdrive input shaft that is pivotally connected to the thrust bearing assembly;

first and second, non-coaxial propeller shafts contained within the articulated outdrive wherein each propeller shaft has a forward driven end, an aft driving end, and a longitudinal axis of rotation;

a surface-piercing propeller connected to the aft driving end of each propeller shaft; and a rudder extending from said articulated outdrive.

2. The dual propeller surface drive propulsion system of claim 1, wherein said drive shaft is pivotally attached to said thrust bearing assembly by a first double universal joint.

3. The dual propeller surface drive propulsion system of claim 2, wherein said thrust bearing assembly is pivotally attached to the articulated outdrive input shaft by a second double universal joint.

4. The dual propeller surface drive propulsion system of claim 1, further including a gearbox system contained within the articulated outdrive;

said gearbox system connecting said outdrive input shaft with said two propeller shafts; and wherein said gearbox system includes means for providing counter-rotational turning of the first and second non-coaxial propeller shafts about their axes of rotation.

5. The dual propeller surface drive propulsion system of claim 4, wherein the means for providing counter-rotational turning of the two propeller shafts includes;

an upper changeable ratio gear connected to said outdrive input shaft;

said upper changeable ratio gear engaging a lower changeable ratio gear which is mounted for rotation with a main drive gear;

said main drive gear engaging a port idler gear and a starboard idler gear;

a port propeller shaft gear mounted on the forward end of said first propeller shaft, said port propeller shaft gear engaging said port idler gear;

a starboard secondary idler gear engaging said starboard idler gear; and a starboard propeller shaft gear mounted on the forward end of said second propeller shaft, said starboard propeller shaft gear engaging said starboard secondary idler gear.

6. The dual propeller surface drive propulsion system of claim 5, wherein said upper changeable ratio gear, said lower changeable ratio gear, said main drive gear, said port idler gear, said starboard idler gear, said starboard secondary idler gear, said port propeller shaft gear and said starboard propeller shaft gear have axes of rotation that are parallel.

7. The dual propeller surface drive propulsion system of claim 1, further including a hydraulic trim cylinder pivotally connected to said gimbal box, said hydraulic trim cylinder having a hydraulic trim ram pivotally connected to said articulated outdrive;

wherein the articulated outdrive may be trimmed up or down by the application of hydraulic pressure in the hydraulic trim cylinder.

8. The dual propeller surface drive propulsion system of claim 1, further including a hydraulic steering cylinder pivotally connected to said transom box, said hydraulic steering cylinder having a hydraulic steering ram pivotally connected to said gimbal box;

wherein the articulated outdrive may be directed to port or to starboard by the application of hydraulic pressure in the hydraulic steering cylinder.

9. The dual propeller surface drive propulsion system of claim 1, further including:

a hydraulic trim cylinder pivotally connected to said gimbal box, said hydraulic trim cylinder having a hydraulic trim ram pivotally connected to said articulated outdrive;

wherein the articulated outdrive may be trimmed up or down by the application of hydraulic pressure in the hydraulic trim cylinder; and a hydraulic steering cylinder pivotally connected to said transom box, said hydraulic steering cylinder having a hydraulic steering ram pivotally connected to said gimbal box;

wherein the articulated outdrive may be directed to port or to starboard by the application of hydraulic pressure in the hydraulic steering cylinder.

10. The dual propeller surface drive propulsion system of claim 1, wherein said rudder extends from said articulated outdrive amidships and forward of said propellers.

* * * * *